US006869161B2

(12) United States Patent
Wouters et al.

(10) Patent No.: US 6,869,161 B2
(45) Date of Patent: Mar. 22, 2005

(54) METHOD FOR CLEANING A NOZZLE PLATE

(75) Inventors: Paul Wouters, Bonheidenl (BE); Luc De Roeck, Kontich (BE)

(73) Assignee: Agfa-Gevaert, Antwerp (BE)

( * ) Notice: Subject to any disclaimer, the term of this patent is extended or adjusted under 35 U.S.C. 154(b) by 0 days.

(21) Appl. No.: 10/607,034

(22) Filed: Jun. 26, 2003

(65) Prior Publication Data

US 2004/0001116 A1 Jan. 1, 2004

Related U.S. Application Data

(60) Provisional application No. 60/394,394, filed on Jul. 8, 2002.

(30) Foreign Application Priority Data

Jun. 28, 2002 (EP) ..... 02100759

(51) Int. Cl.[7] ..... B41J 2/165
(52) U.S. Cl. ..... 347/28; 347/33
(58) Field of Search ..... 347/22, 24, 28, 347/29, 30, 32, 33, 35

(56) References Cited

U.S. PATENT DOCUMENTS

| | | | | |
|---|---|---|---|---|
| 4,340,897 A | | 7/1982 | Miller | |
| 5,793,390 A | * | 8/1998 | Claflin et al. | 347/33 |
| 5,864,348 A | | 1/1999 | Fritsch et al. | |
| 6,241,337 B1 | | 6/2001 | Sharma et al. | |

FOREIGN PATENT DOCUMENTS

| | | |
|---|---|---|
| EP | 1 080 909 A1 | 3/2001 |
| EP | 02 10 0759 | 11/2002 |
| JP | 06048361 | 2/1994 |

* cited by examiner

*Primary Examiner*—Shih-Wen Hsieh
(74) *Attorney, Agent, or Firm*—John A Merecki; Robert A. Sabourin

(57) ABSTRACT

A method for cleaning the nozzle plate of an inkjet printhead includes the steps of: providing a solvent on the nozzle plate; loosening debris collected on the nozzle plate by brushing the nozzle plate in the presence of the solvent with a brush; applying a cleaning solvent to the nozzle plate, and subsequently removing the cleaning solvent and debris from the nozzle plate by vacuum cleaning. Application of the cleaning solvent and the subsequent removal of the cleaning solvent provides a movement of solvent over the nozzle plate.

12 Claims, 4 Drawing Sheets

METHOD FOR CLEANING A NOZZLE PLATE

The application claims the benefit of U.S. Provisional Application No. 60/394,394 filed Jul. 8, 2002.

FIELD OF THE INVENTION

The present invention relates to inkjet printing mechanisms, such as printers or plotters.

More particularly the present invention relates to a mechanism for cleaning a printhead.

BACKGROUND OF THE INVENTION

Nowadays inkjet printing systems are used in a wide array of apparatuses and in a wide array or applications such as fax, colour photo printing, industrial applications, etc. In theses printing systems inks, possibly of various colours, are ejected out of at least one array of nozzles located in a printhead to the receiving material.

A long known problem in inkjet printers is that the nozzles through which the ink is projected to the receiving material are blocked by clogging of ink inside the nozzles and on the printhead. This renders certain nozzles inoperable and results in a defective print or deteriorated print quality.

To improve the clarity and contrast of the printed image, recent research has been focused to improvement of the inks. To provide quicker, more waterfast printing with darker blacks and more vivid colours, pigment based inks have been developed. These pigment-based inks have a higher solid content than the earlier dye-based inks. Both types of ink dry quickly, which allows inkjet printing mechanism to form high quality images. In some industrial application, such as making of printing plates using ink-jet processes, inks having special characteristics causing specific problems. E.g. UV curable inks exit to allow rapid hardening of inks by UV radiaation after printing.

The combination of small nozzles and quick drying ink leaves the printheads susceptible to clogging, not only from dried ink and minute dust particles or paper fibres, but also from the solids within the new inks.

It is known to counteract or correct the problem of clogging by protecting and cleaning the printhead by various methods.

Capping: during non-operational periods the printhead can be sealed off from contaminants by a sealing enclosure. This also prevents the drying of the ink. The capping unit usually consists of a rubber seal placed around the nozzle array.

Spitting: by periodically firing a number of drops of ink through each nozzle into a waste ink receiver, commonly called a spittoon, clogs are cleared from the nozzles. This can be concentrated to nozzles which are not used for a certain time but usually all the nozzles are actuated during spitting.

Vacuum assisted purging: During a special operation, in order to clear partially or fully blocked nozzles, a printing cycle is actuated while on the outside of the nozzles a vacuum is applied. This helps clearing and cleansing of the nozzles. The purging is normally performed when the printhead is in the capping unit because this unit can provide a good seal around the nozzle array for building the vacuum.

Application of solvents: By applying solvent ink residue is dissolved and the printhead can be cleaned as described in EP-A-1 018 430 herein incorporated by reference in its entirety for background information only.

Wiping: Before and during printing, the inkjet printhead is wiped clean by using an elastomeric wiper, removing ink residue, paper dust and other impurities.

Different combinations of the above method are known to clean the inkjet printheads.

In U.S. Pat. No. 6,241,337, herein incorporated by reference in its entirety for background information only, wiping is performed combined with vibrations and application and removal of a solvent. The wiping action and the vibrations are especially abrasive for the nozzle plate.

In U.S. Pat. No. 5,557,306, herein incorporated by reference in its entirety background information only, ink is released from the nozzle plate, and the plate is brushed and wiped afterwards. Due to the wiping action, wear and tear of the nozzle plate is considerable.

The system described in U.S. Pat. No. 6,164,754, herein incorporated by reference in its entirety for background information only, uses only longitudinal cleaning with an elastic pillar like member for cleaning the printhead having an indented groove with a nozzle section eventually combined with an elastic. This gives an unsatisfactory result and may also result in damage to the printhead.

The features designed to clean and to protect a printhead, are commonly concentrated in a service station which is mounted within the plotter chassis, whereby the printhead can be moved over the station for maintenance. An example of such a service station can be found in U.S. Pat. No. 6,193,353, herein incorporated by reference in its entirety for background information only, combining wiping, capping, spitting and purging functions.

As explained above cleaning actions, such as wiping, cause considerable wear and tear upon the nozzle plate. Special coatings present on the nozzle plate, in order to make the plate ink-repellent, tend to be damaged and therefor the printheads need to be replaced often. This is a cause of considerable cost.

Another problem is that certain prior art cleaning methods are not well suited for every type of ink.

There is a need to provide cleaning methods for nozzle plates causing less wear and tear while providing sufficient cleaning.

SUMMARY OF THE INVENTION

A method for cleaning the nozzle plate of an inkjet printhead includes the steps of: providing a solvent on the nozzle plate; loosening debris collected on the nozzle plate by brushing the nozzle plate in the presence of the solvent with a brush; applying a cleaning solvent to the nozzle plate; and subsequently removing the cleaning solvent and debris from the nozzle plate by vacuum cleaning. Application of the cleaning solvent and the subsequent removal of the cleaning solvent provides a movement of solvent over the nozzle plate.

Further advantages and embodiments of the present invention will become apparent from the following description and drawings.

DETAILED DESCRIPTION OF THE PREFERRED EMBODIMENTS

A sufficient and non-abrasive cleaning method is provided by steps providing a combination of wet brushing and solvent cleaning wherein a movement of solvent is provided over the nozzle plate.

First a solvent is applied on the nozzle plate

Another step is provided for loosening debris collected on the nozzle plate by brushing the nozzle plate with a brush in presence of the solvent.

Two steps provide solvent cleaning of the nozzle plate:

In a separate step or a step combined with the first above a cleaning solvent is applied.

Finally the nozzle plate is vacuum cleaned.

The brushing step in presence of a liquid or solvent has the advantage that wet brushing is less abrasive than dry brushing and the wet brushing step is very effective in loosening debris collected on the nozzle plate.

The steps of applying a cleaning solvent and subsequent vacuum cleaning cause a movement of solvent over the nozzle plate which is very effective in removing debris and ink residue from the nozzle plate and clearing the nozzles.

Several embodiments using the method of the present invention will be given hereafter.

First Embodiment

In the following example wet brushing and solvent cleaning is provided in four different steps.

Figure 1:
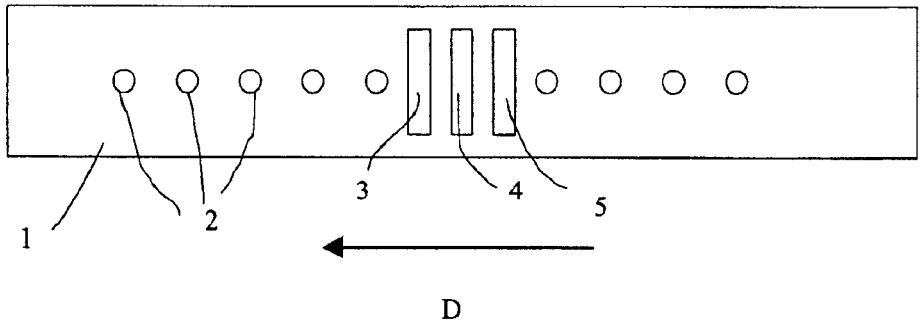
FIG. 1 shows the layout of components of a first embodiment according to the present invention.

Reference is made to FIG. 1 wherein a nozzle plate 1 including nozzles 2 is depicted.

The different steps of the method are performed by separate means 3,4,5 which move over the nozzle plate 1 in the direction indicated by the arrow D. The different steps performed by the separate means therefor are performed consecutively and continuously at different location.

In a first step a solvent is applied to the nozzle plate 1. In this embodiment the ink itself is used as a solvent. The ink is a water based ink which can be easily used as a solvent due to lower drying speeds. The application is performed by bleeding ink from the nozzles 2 by jetting ink with very low power so that it remains on the nozzle plate 1. It is also possible to use a special solvent applied by a special application means, e.g. an non image-wise jetting system.

The second step is performed by moving a brush 3 over the nozzle plate 1. The brush 3 contacting the nozzle plate 1 consists of a woven fabric of polytetrafluoroethylene (PTFE), commonly known as TEFLON®. Other types of brush 3 could be used.

The wet brushing step ensures an abrasive-free loosening of ink residue and other debris collected on the nozzle plate 1.

After wet brushing a cleaning solvent is applied by e.g. a jetting means 4. The solvent could also be applied using a contact system but preferably a non-contact system is used.

Directly after the application of the cleaning solvent on the nozzle plate 1 it is removed by vacuum cleaning by a vacuum cleaning means 5. Due to the constant application of the cleaning solvent and the vacuum cleaning a movement of the solvent is created on the nozzle plate 1 over the nozzles 2 in a direction opposite to the movement of direction D.

The movement of the solvent provides a mechanical effect of the cleaning solvent dragging loose particles along the nozzle plate. Another fact is that due to the movement, dissolving of ink residues is improved. This can be contributed to the same effect causing that a solid is faster dissolved when a solvent and solid are stirred.

Second Embodiment

Figure 2:
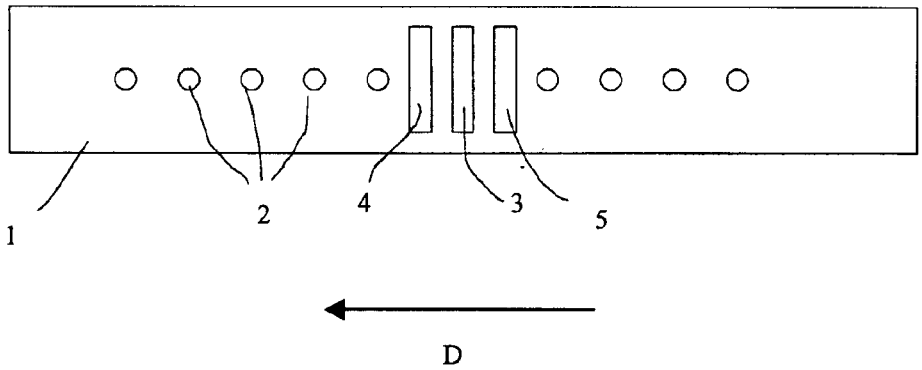
FIG. 2 shows the layout of components of a second embodiment according to the present invention wherein the solvent application and the cleaning solvent application are the same step.

It is possible that the step of applying a solvent in order to enable wet brushing can be combined with the step of applying a cleaning solvent. This results in the configuration of FIG. 2. In a first step a solvent is applied to the nozzle plate 1 by a jetting means 4 or any other appropriate system. The solvent serves two purposes, to enable wet brushing and serve as a cleaning solvent.

This way no ink is wasted to enable wet brushing and no two separate solvent applications have to be done.

Directly after application the nozzle plate 1 is brushed using a brush 3. A non-woven felt was used contacting the printhead. Likewise as in the above example the last step is a vacuum cleaning step and likewise a movement of solvent is generated between the jetting means 4 and the vacuum cleaning means 5. The brush 3 will not obstruct the solvent flow if a system is provided using a brush 3 having a certain permeability.

This system has a supplementary advantage that the brush 3 itself is also cleaned or rinsed by the flow of solvent trough it.

The system provided a good cleaning with less apparent wear to the nozzle plate 1.

Further possible embodiments and alternatives are described below together with related considerations.

Brush

The constitution of the brush 3 may vary, any appropriate woven fabric e.g. velvet or non-woven e.g. felt brush 3 can be used. The chemical composition of the brush 3 can be adapted to the composition of the ink and/or the nozzle plate 1. Possible materials which can be used and have proven effectiveness are e.g. polytetrafluoroethylene (PTFE) and polypropylene. Other materials are possible. The following list is not to be considered limitative: PTFE, PP, PET, PUR, Nylon . . . Making the brush 3 from PTFE has the advantage that the brush fibres are chemical inert and that the brush 3 has certain self cleaning properties. Low hardness of the material avoids scratching of the nozzle plate.

The brush 3 may also help the cleaning process by creating a more uniform solvent flow over the printhead.

The constitution of the brush 3 is a trade-off between several desired parameters. E.g. in order to provide good brushing and exert a certain force of the printhead 1 the brush fibres need to have a certain rigidity and more fibres or brush hairs enable better cleaning. However when the steps of applying a solvent and applying a cleaning solvent are combined, a certain porosity of the brush 3 has to be present to allow the movement of solvent over the nozzle plate 1.

Figure 4:
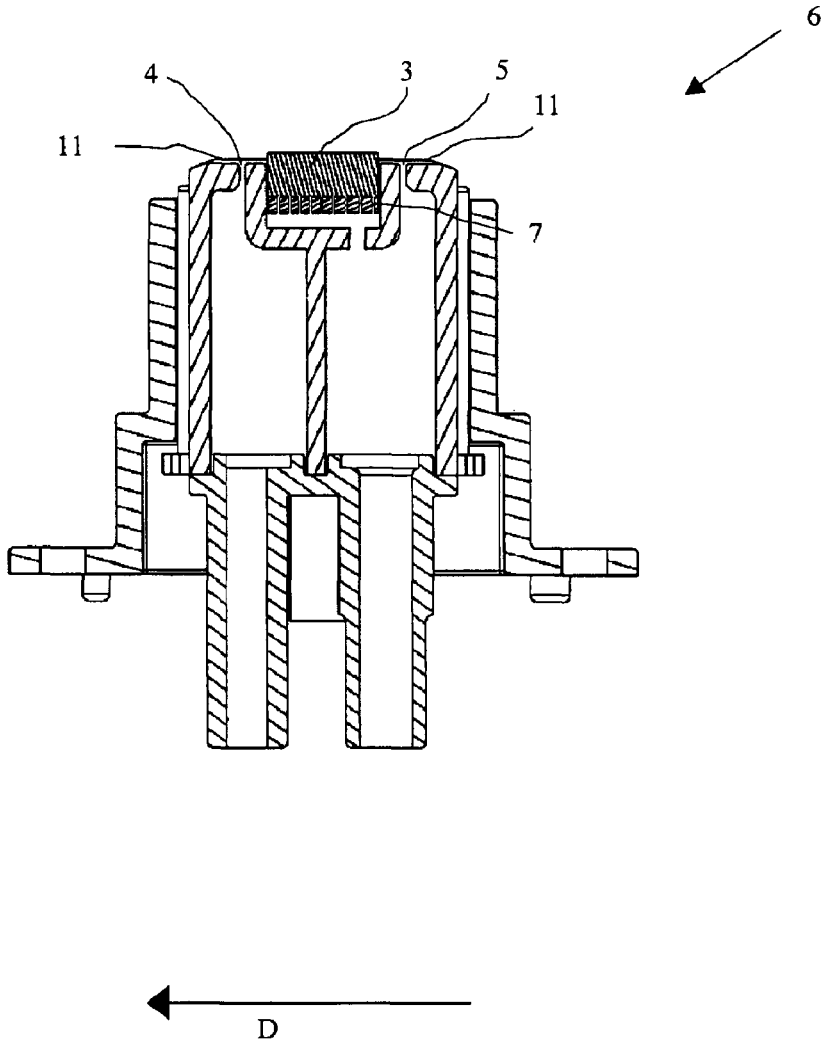
FIG. 4 shows a cleaning module having extra vacuum cleaning through the brush.

As illustrated in FIG. 4 the hairs of the brush 3 can be mounted on a perforated base 7. This allows a easy removal of debris and solvent in an additional way. This can be enhanced by applying a light vacuum at the perforations.

The brush 3 may be fixed, but especially when using very viscous inks, it may be more efficient to provide an automatic mechanism to renew the brush 3.

Figure 5:
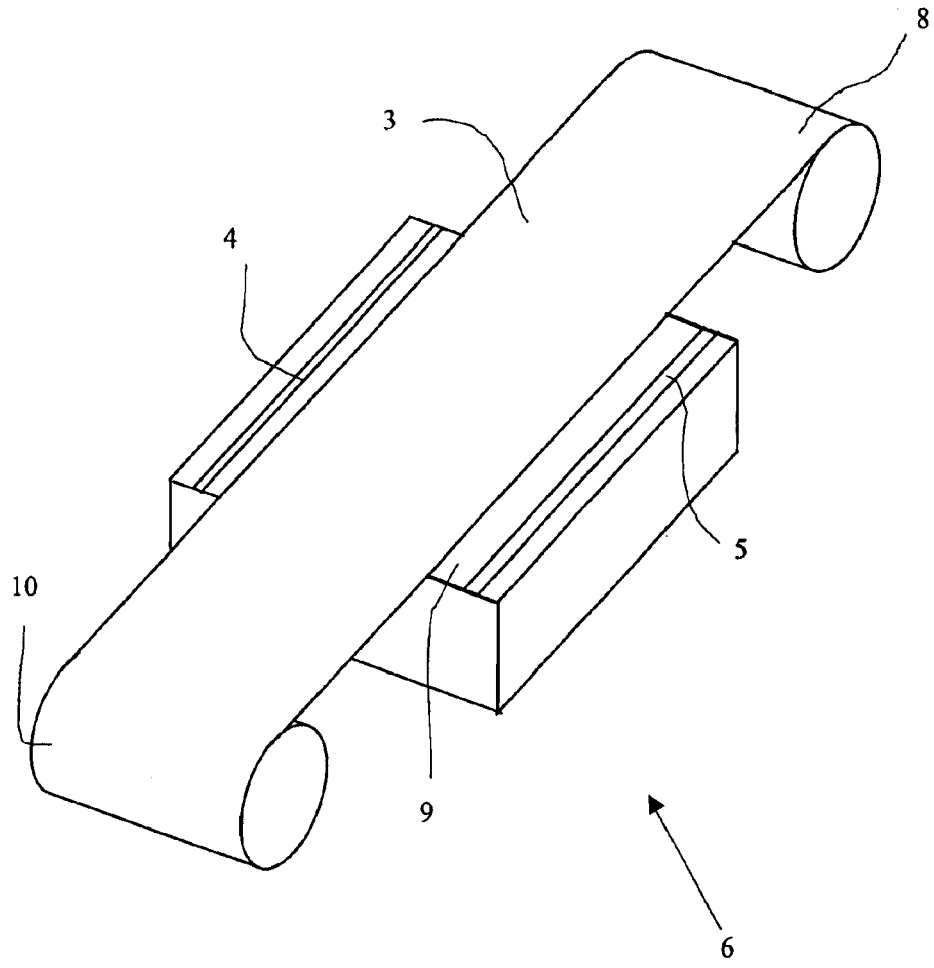
FIG. 5 depicts a cleaning module having a system for renewing the brush fabric.

FIG. 5 depicts such a possible mechanism is a system comprising a brush 3 in the form of a fabric ribbon 3. The apparatus then comprises a pay-out roll 8 for feeding fresh brush fabric 3 to the cleaning module 6, a brush surface 9 for supporting the section of the ribbon in use as active brush 3, a take-in roll 10 for rolling up used brush fabric.

This provides easy renewal of the brush 3 when needed.

Direction and Speed of Cleaning

The most preferable cleaning system sweeps the printhead in a longitudinal direction, however, depending on the size of the head or internal printer arrangement transversal cleaning or cleaning in any direction across the nozzle array is also possible.

Cleaning speeds may vary between 0.001 and 0.05 m/s but are preferably between 0.005 and 0.02 m/s The cleaning module or station 6 may be stationary and cleaning is performed by travelling the printhead over the cleaning station, but also a moving cleaning station 6 moving over the printhead is possible.

To enhance the cleaning capacity it is possible to provide extra movement of the brush 3. During the translation movement the brush 3 may be oscillated or vibrated enhancing the dissolving capabilities. Also the introduction of sonic or ultrasonic vibrations enhances loosening of debris and dried ink. These movements can e.g. be actuated by a piezo-electric transducer.

The brush 3 can also be a rotating brush, which can be cleaned by using a stationary scraper wiping collected debris from the hairs of the brush.

Brush Conditioning

It has been found that when the brush 3 has dried, e.g. due to a long time of inactivity, a certain time is needed to fully get wet again and cleaning is inefficient at first. This can be avoided by storing the inactive cleaning module or the brush 3 in a capping inside the printer avoiding drying of the brush 3 by keeping a solvent saturated atmosphere.

Inside the capping the cleaning module can be activated to rinse the brush 3 free of debris and dried particles.

When using a cleaning solvent, cleaning and dissolving power is greatly determined by the properties of the solvent.

One of the most important properties is the surface tension.

When the surface tension is too low, a thin film will be left on the nozzle plate forming small drops which will after drying result in small dry particles. A high surface tension enables easy removal of the solvent but makes it difficult to bring solvent and contaminant (dried ink, debris) into contact.

Another aspect is the chemical compatibility of the solvent with the contaminants Pure ink is normally fully chemically compatible with dried ink and has a low surface tension and therefore can not be easily removed by vacuum.

Pure water can be easily removed but has reduced dissolving power. A trade-off between wetting capability and dissolving power has to be found. This can be done by mixing e.g. ink with a solvent. Further aspects influencing the cleaning capacity of the cleaning solvent are e.g. Composition of the anti-wetting coating of the nozzle plate 1, possible additives in the solvent, temperature of the solvent, . . .

Another aspect is that the volume of cleaning solution has to be balanced with the strength of the vacuum. When the vacuum is too low, cleaning solution will be left on the printhead, while when the vacuum is too low, not enough time is given to loosen and dissolve the dried ink and debris.

When solvent is removed by vacuum cleaning solvent can be collected as a waste product for later removal. However in a more preferable embodiment the solvent is recycled and reused after e.g. filtering or other purification methods. This reduces waste generation of the printer.

Jetting of cleaning solvent

In order to generate the flow or movement of solvent over the nozzle plate 1, the cleaning solvent is preferably jetted onto the nozzle plate 1 by the solvent applying means 4 at an angle with the normal of the nozzle plate 1 between 0 and 80 degrees.

This provides a good in depth cleaning of the nozzles 2 and enables the generation of the solvent flow over the nozzle plate 1. Direction of the jet can be adapted to desired cleaning speed or jetted volumes. The solvent flow is preferably between 5 to 200 ml/min in feed-through inlet 7.

Instead of using a standard laminar flow of the applied solvent more efficient regimes are possible:

Air bubbles are introduced in the flow of the cleaning solvent, this gives a more aggressive and efficient cleaning.

a pulsing solvent flow also gives more efficient cleaning.

Vacuum cleaning

Vacuum cleaning serves a double function:

removal of the cleaning solution and debris.

the vacuum directs the flow of the cleaning fluid.

Normally the solvent jetting module 4 applying the solvent travels over the printhead first after which the vacuum cleaning means 5 will remove the solvent. Flow direction is then reverse to the movement direction of the cleaning module 6.

However by applying a stronger vacuum it is possible that the vacuum cleaning means 5 passes first over the printhead before the cleaning fluid jetting module 4. The cleaning solvent has then to drawn to the vacuum means 5 in the same direction as the movement of the cleaning module 6. This clearly requires a stronger vacuum. The pressure P inside the printhead under the vacuum slit 5 usually is between −0.05 and −0.50 bar.

The first value is the minimum for removing the solvent while the second value results in good cleaning without extracting too much ink from the nozzles 2 of the printhead.

The same considerations have to be taken into account when determining the distance of the cleaning module 6 to the surface of the nozzle plate 1.

When distance is too close the printhead may be accidentally damaged, ink extraction out of the nozzles 2 is high, solvent flow is difficult, etc. . . . . When the distance between head and cleaning module 6 is too large, bad cleaning due to loss of vacuum etc may be expected.

Used distances may vary between 0.1 and 1.0 mm depending upon applied vacuum and solvent flow.

The distance between the cleaning module 6 and the nozzle plate 1 can be maintained by providing protrusions 11 on the cleaning module 6. These protrusions 11 preferably are located outside of the cleaning area and contact the printhead outside of the nozzle plate 1. As cleaning is performed the protrusions 11 slide over the printhead and thus keep a constant distance to the nozzle plate 1 located in between the sliding contact.

Ideal combination of parameters for all cleaning components has to be found in a case by case basis.

A change in ink composition, cleaning speed, brush properties, . . . all have an influence on the cleaning results.

E.g. plural setting can be tried out for determining ideal parameters, e.g. for the cleaning module 6 for determining working point without leakage of cleaning fluid from the cleaning module 6.

The right combination of flow of cleaning solvent and air extraction by the vacuum unit 5 is important.

Working points are to be determined and can vary very largely depending upon various parameters:

Type and size of the brush, distance of the cleaning module to the nozzle plate, geometry of the cleaning module: width, length, distance between the fluid application and vacuum slit and their distance to the brush and the edges of the cleaning module.

Length and width of the slits.

Changing these parameters can e.g. allow for a working point having a need for a lower vacuum, which can be easier obtained.

EXAMPLE

Figure 3:
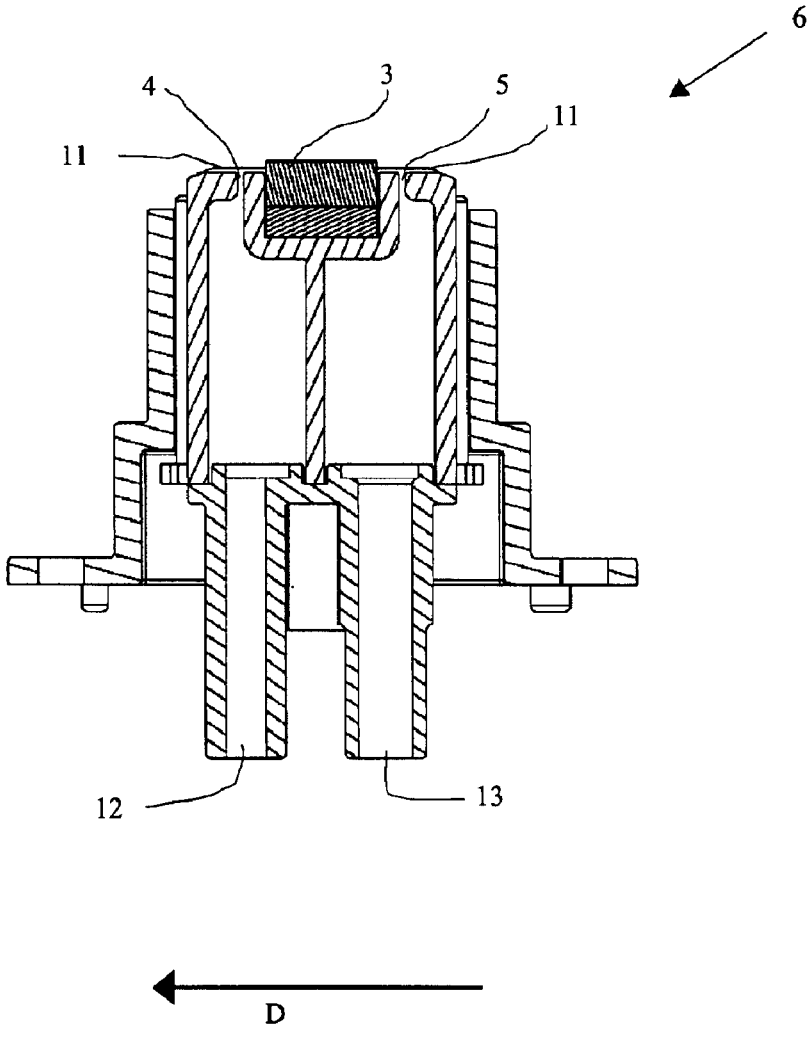
FIG. 3 shows a cleaning module for executing the steps according to the present invention.

An inkjet printing system was equipped with a cleaning module 6 shown in FIG. 3 for executing the method according to the present invention.

The printer uses a waterbased dye ink.

The module 6 bi-directional traverses over the printhead with the last sweep in the direction D indicated by the arrow wherein the vacuum slit 5 always passed the printhead last. Normally only one back and forth sweep is used. This provides sufficient cleaning for the printhead.

Module 6 comprises a slit or nozzle array 4 for applying solvent to the inkjet printhead.

Following setting have proven to result in good cleaning results.

The applied volume of cleaning solvent is 45 ml/min and in feed-through inlet 12.

Vacuum is applied and a flow of about 58 l/min of air is obtained by setting a pressure of −0.1 barrel in the vacuum chamber behind the slit 5.

In the centre the brush 3 for brushing the printhead is provided. At the other side a slit 5 is connected to a vacuum source via a vacuum connection 13. The opening of the slits 4 and 5 are 0.5 mm wide.

The module 6 traverses over the printhead at a speed between 0.005 and 0.05 m/sec at a distance of 0.3 mm from the nozzle plate 1.

An effective method of conditioning the printhead for further printing can be provided by the steps of:

Vacuum assisted purging : during this step a vacuum is applied on the outside of the nozzle plate 1. This can be done by bringing the printhead in contact with a capping unit which is connected to a vacuum source. If necessary the nozzles 2 of the printhead are fired to help clearing of blocked nozzles 2.

During a spitting step the printhead is driven to further clear the nozzles 2.

A cleaning step according to the present invention is provided

To preserve the printhead in a ready state the printhead is brought in contact with a capping unit to prevent further contamination and drying of ink in the nozzles 2.

Especially the combination of the vacuum assisted purging step and the improved cleaning are essential to provide a good conditioning of the printhead. Spitting can be performed and capping is only necessary when printing is not started immediately.

The cleaning module 6 can be specially designed to work bi-directionally. Centrally a liquid jetting section is provided in between two brushes. At the outer sides two vacuum modules 5 are provided. This allows for the use of the jetting, brushing, vacuum treatment in both directions of movement.

Having described in detail preferred embodiments of the current invention, it will now be apparent to those skilled in the art that numerous modifications can be made therein without departing from the scope of the invention as defined in the appending claims.

What is claimed is:

1. Method for cleaning a nozzle plate of an inkjet printhead comprising the steps of:

providing a solvent on said nozzle plate, loosening debris collected on said nozzle plate by brushing said nozzle plate in presence of said solvent with a brush, applying a cleaning solvent to said nozzle plate, subsequently removing said cleaning solvent and debris from said nozzle plate by vacuum cleaning, characterized in that the application of said cleaning solvent and said subsequent removal of said cleaning solvent provides a movement of solvent over the nozzle plate.

2. Method according to claim 1 wherein the solvent is provided on the nozzle plate by bleeding ink from the nozzles.

3. Method according to claim 1 wherein the step of providing said solvent and the step of applying said cleaning solvent are the same.

4. Method according to claim 1 wherein said brush is composed of polytetrafluoroethylene, Polypropylene, Polyurethane, or Nylon.

5. Method according to claim 1 wherein cleaning of the nozzle plate is performed by a cleaning module translating over the nozzle plate.

6. Method according to claim 5 wherein a speed of the cleaning module is between 0.001 and 0.05 meter/sec.

7. Method according to claim 1 wherein cleaning of the nozzle plate is performed by the printhead translating over the cleaning module.

8. Method for conditioning a printhead in an inkjet printer comprising the steps of:

vacuum assisted purging and, cleaning the nozzle plate according to a method of claim 1.

9. Cleaning module for cleaning a nozzle plate from an inkjet printer comprising:

means for providing a cleaning solvent on said nozzle plate, a brush for brushing said nozzle plate in presence of said cleaning solvent to loosen debris collected on said nozzle plate, vacuum cleaning means for providing a movement of cleaning said solvent over the nozzle plate, and for removeing said cleaning solvent and debris from said nozzle plate.

10. Cleaning module according to claim 9 wherein the brush is comprised of brush fabric from a brush unit comprising:

a pay-out roll for feeding said brush fabric to the brush, a brush surface for supporting the brush, and a take-in roll for rolling up used brush fabric.

11. Inkjet printer having a cleaning module for cleaning a nozzle plate of the inkjet printer, the inkjet printer comprising:

means for providing a cleaning solvent on said nozzle plate, a brush for brushing said nozzle plate in presence of said cleaning solvent to lossen debris collected on said nozzle plate, vacuum cleaning means for providing a movement of said cleaning solvent over the nozzle plate, and for removing said cleaning solvent and debris from said nozzle plate.

12. Inkjet printer according to claim 11 further comprising recycling means for recycling the removed cleaning solvent.

* * * * *